United States Patent [19]

Kleiman

[11] 4,284,258

[45] Aug. 18, 1981

[54] FESTOON SUPPORT DEVICE

[76] Inventor: Stanley Kleiman, 15 Parson Pl., Colonia, N.J. 07067

[21] Appl. No.: 24,585

[22] Filed: Apr. 25, 1979

[51] Int. Cl.[3] ..... A47H 1/14

[52] U.S. Cl. ..... 248/251; 160/330

[58] Field of Search ..... 248/251, 267, 261, 262, 248/266, 268, 269, 252, 254, 255, 257; 160/330

[56] References Cited

U.S. PATENT DOCUMENTS

| | | | |
|---|---|---|---|
| 1,018,110 | 2/1912 | Hogle | 248/267 |
| 1,116,173 | 11/1914 | Uffelman | 248/252 |
| 1,302,292 | 4/1919 | Blake | 248/252 |
| 2,316,337 | 4/1943 | Kenney | 160/330 |
| 2,480,360 | 8/1949 | Doty | 248/252 |
| 2,614,305 | 10/1952 | Yeardley | 248/316 D UX |
| 2,823,743 | 2/1958 | Isaac | 248/262 X |
| 2,891,295 | 6/1959 | Little | 248/316 D UX |
| 3,064,724 | 11/1962 | Nowell | 160/330 |
| 3,346,227 | 10/1967 | Hankin | 248/262 |
| 3,889,912 | 6/1975 | Ray | 248/269 X |

FOREIGN PATENT DOCUMENTS

| | | | |
|---|---|---|---|
| 720438 | 12/1954 | United Kingdom | 160/330 |

*Primary Examiner*—J. Franklin Foss

*Attorney, Agent, or Firm*—Howard C. Miskin

[57] ABSTRACT

A festoon support device includes a pair of mounting brackets and a forwardly projecting festoon support arm separably coupled to each of the brackets. A depending loop is integrally formed at the rear portion of each arm to securely allow the arm to rest on a curtain rod without tipping and a spring clip is located on the arm rear top face for engaging a festoon. An angularly adjustable ornament is separably mounted on the front of each arm. The mounting brackets are constructed to be clamped to a wall by underlying wall fastened traverse or other type of rod brackets except common curtain rods, where their use is not necessary, and engaging the screws securing the rod brackets. They are also for use when mounting the festoon holder alone to a surface.

6 Claims, 5 Drawing Figures

FESTOON SUPPORT DEVICE

BACKGROUND OF THE INVENTION

The present invention relates generally to improvements in drapery hardware and it relates more particularly to an improved structure for supporting a festoon.

It is frequently desirable to concurrently support festoons and curtains or drapes, often together with traverse rod carried drapes. The structures heretofore available or proposed for this purpose possess many drawbacks and disadvantages. They are awkward and inconvenient to use, are of little versatility and adaptability and otherwise leave much to be desired in the event they are to be used where a different window treatment had been used, they cannot be mounted in place without the necessity of moving drapery hardware already mounted in the area they must occupy and then they must be screwed in that place.

SUMMARY OF THE INVENTION

It is a principal object of the present invention to provide an improved festoon support structure.

A further object of the present invention is to provide an improved festoon support structure that can be used, or its use discontinued, without the necessity for removing any drapery hardware which already may have been placed on the window frame or wall.

Another object of the present invention is to provide an improved festoon structure which may selectively be employed with curtain and traverse rods without the necessity of separately placing it in perfect relationship to these rods or screwing it in place.

Still another object of the present invention is to allow discontinuance of its use and its removal without removing screws, leaving holes and necessitating the remounting of hardware which may have been in its place.

Still another object of the present invention is to provide an improved festoon support structure which is easily separably wall mounted.

Another object of the present invention is to provide an improved festoon support structure adjustably carrying ornamental devices.

Still another object of the present invention is to provide a structure of the above nature characterized by its attractive appearance, ruggedness, reliability, ease of application and great versatility and adaptability.

The above and other objects of the present invention will become apparent from a reading of the following description taken in conjunction with the accompanying drawings which illustrate a preferred embodiment thereof.

In a sense the present invention contemplates the provision of an improved festoon support device which comprises a mounting bracket, a forwardly projecting festoon support arm separably connected at its rear to the mounting bracket, a positioning stop located on the support arm and an ornament mounted on the front end of the support arm. In general application, a pair of laterally spaced brackets are provided with a festoon support arm mounted on each of the brackets and a curtain rod may extend between the support arms.

In accordance with a preferred form of the improved festoon support device, the mounting bracket includes a pair of parallel confronting coupling channels and the festoon arm terminates at its rear in an upwardly projecting flange and a depending socket defining loop for releasably receiving an end of a curtain rod, the flange and the bottom of the loop slidably engaging the opposing channels. An ornamental device is angularly adjustably mounted on the support arm front end and a clip leaf spring extends longitudinally and is anchored at its rear end to the support arm rear top face and is flanked by serrated surfaces formed in the support arm top face for releasably engaging and retaining a festoon. The mounting bracket is provided with horizontal slots open at their inner ends to facilitate the wall mounting of the bracket with a traverse rod support bracket overlying the festoon arm support bracket or the support bracket may be directly wall mounted.

The improved festoon support structure is rugged and attractive, easy to apply and of great versatility and adaptability.

DESCRIPTION OF THE PREFERRED EMBODIMENT

Figure 1:
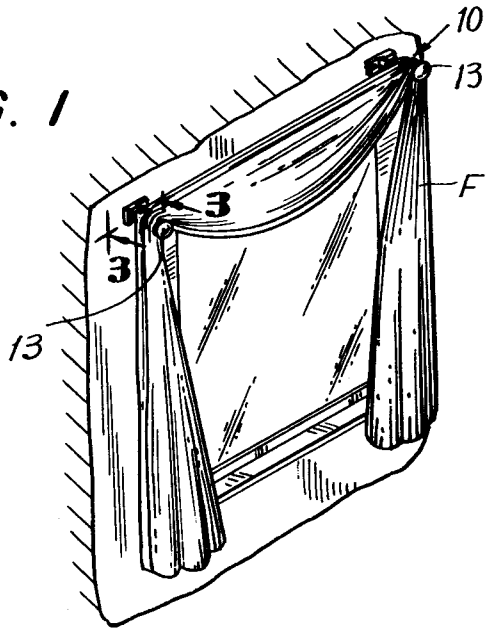
FIG. 1 is a perspective view of the improved festoon support device shown in mounted operative condition.

Referring now to the drawings which illustrate a preferred embodiment of the present invention, the reference numeral 10 generally designates the improved festoon support device which includes a mounting bracket 11 a festoon and support member 12 and a decorative or ornamental member 13. The support member 12 is illustrated as applicable for use with a length of traverse rod or a conventional adjustable curtain rod, terminating at its opposite outer ends in rearwardly directed legs, not shown. It should be noted that where traverse rods or curtain rods are not to be used, a pair of laterally spaced support devices 10 are employed and are individually supported by respective wall mounted bracket 11, otherwise support devices 10 are mounted on the curtain rod legs.

Each mounting bracket 11 is an integrally formed unit and includes a rectangular flat rear plate 18 having formed therein a pair of vertically spaced horizontal slots 19 extending to and open at the inner edge of plate 18. A forwardly directed vertical flange 20 is formed along the outer edge of plate 18 and top and bottom forwardly directed parallel horizontal flanges 21 are formed along the rear plate top and bottom edges and extended from flange 20 inwardly to points short of slots 19. A locking projection 15 having an inclined inner face is formed on the front face of plate 18 intermediate the inner end of flanges 21. The flanges 21 terminate in coextensive lips 22 projecting toward each other and defining with corresponding flanges 21 respective guide channels 23.

The support member 12 comprises a forwardly projecting channel shaped arm 24 including a top web 26 and depending flanges 27 and terminating in a longitudinally thick front wall 25. The rear portion of outer flange 27 is provided with longitudinally spaced depending fingers 28, the outer flange 27 having therein forward of perspective fingers 28, recesses 29. The arm 24 terminates at its rear in a bracket and curtain rod coupling defining section 30 in the form of a depending U-shaped loop including vertical side legs 32 coplanar with respective channel flanges 27 and an arcuate bottom cross-piece 33. Projecting upwardly from the rear border of channel top web 26 are a pair of laterally spaced low upward projections 34. The rear portion of support member 12 is separably coupled to mounting bracket 11 with the bottom of cross-piece 33 and projections 34 slidably engaging lower and upper guide channels 23 respectively and outer leg 32 abutting flange 20, the coupling section 30 being releasably retained in coupled condition by locking projection 15. In the coupled condition of support member 12 arm 24 projects horizontally forwardly.

A festoon retaining clip spring 36 is formed of a leaf spring which extends medially longitudinally along the rear top face of channel web 26 and is upwardly bowed, with its rear end welded or otherwise anchored to web 26 and its front end reverse upwardly forwardly curved to provide an entrance throat. Longitudinally extending serrated strips 37 are formed on web 26 on opposite sides of clip spring 36 and are transversely spaced and parallel to each other and included upwardly directed teeth.

A short shank 38 of reduced transverse cross-section projects forwardly from the center of the front face of front wall 25 and terminates at its front in an enlarged vertical flat head 39 coaxial with shank 38 and of polygenal, for example, octogonal configuration. The ornamental device 13, although illustrated as of circular convex configuration may be of any desired shape and is provided proximate its upper border with a rearwardly projecting female coupling 40 open at its bottom and rear. The coupling 40 includes a rearwardly projecting peripheral wall 41 open at its bottom and corresponding to part of the perimeter of head 39, specifically containing five sides of the octagonal perimeter. The peripheral wall 41 terminates at its rear in an inwardly directed peripheral lip 42.

Figure 2:
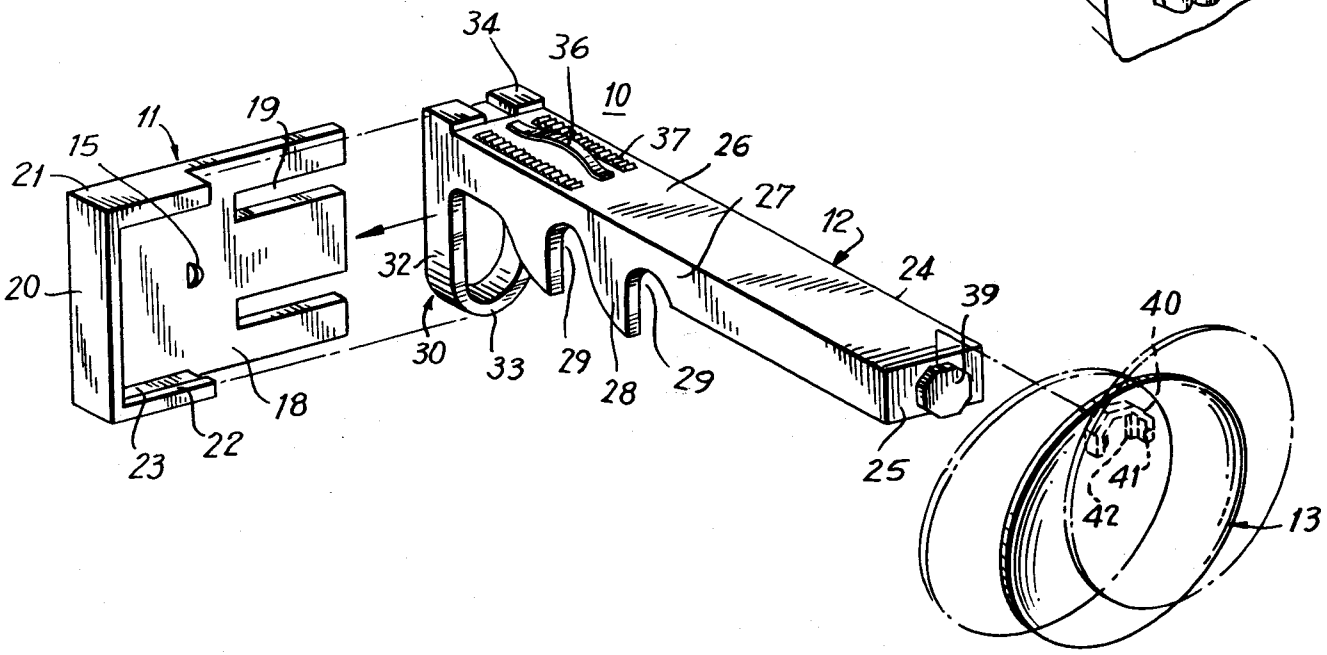
FIG. 2 is an exploded perspective view of the improved device.
Figure 3:
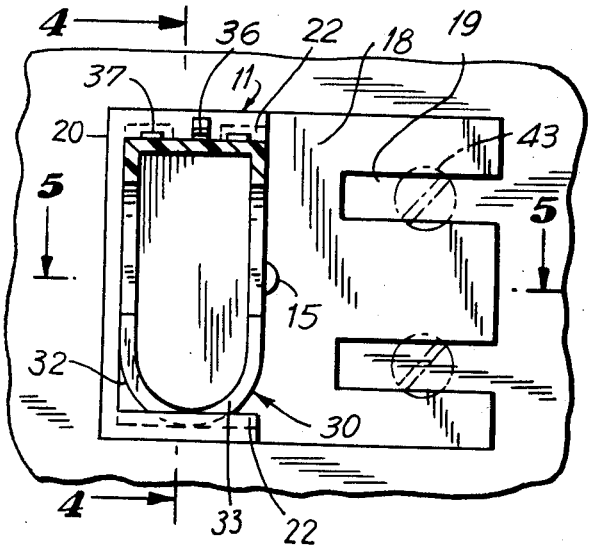
FIG. 3 is an enlarged sectional view taken along lines 3—3 in FIG. 1.
Figure 4:
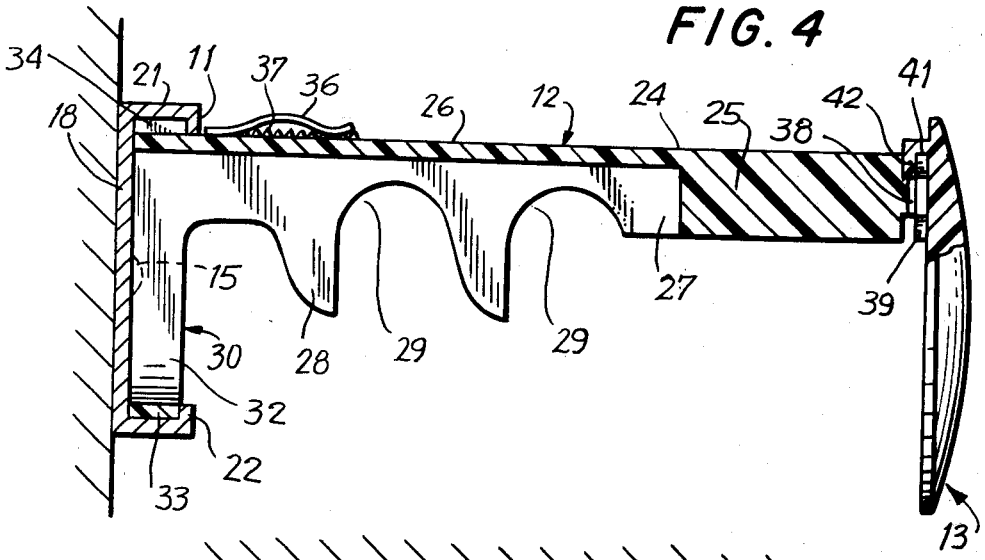
FIG. 4 is a sectional view taken along line 4—4 in FIG. 3.
Figure 4:
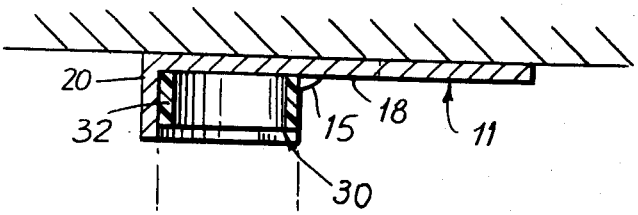
Figure 5:
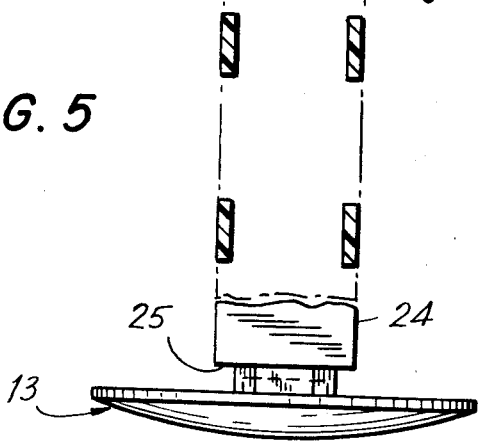
FIG. 5 is a sectional view taken along line 5—5 in FIG. 3.

Thus, the ornamental device 13 is separably angularly adjustably mounted to the front of arm 24 by means of head 39 and coupling 40. In the mounted position of ornamental device 13, wall 41 engages head 39 with the device 13 being in a preselected angular position, as shown either by solid or broken line in FIG. 2, and the lip 42 releasably engages the rear face of head 39. The angle of the device 13 may be adjusted by raising it to uncouple coupling 40 from head 39 and reapplying it in an angularly adjusted position. Other coupling arrangements may be substituted for that illustrated for angularly adjustably mounting the ornamental device 13 to support member 12.

In the mounting of the support devices 10 when employed with a wall mounted traverse rod a festoon support 12 is coupled to each bracket 11 by sliding the coupling 30 and projections 34 along channels 23 into full engagement therewith and past projection 15. The festoon holder 24 is slid into the bracket 11, the traverse rod bracket anchoring screws are loosened and the assembled holder 24 and bracket 11 is slid behind each of the traverse rod brackets with the slots 19 sliding into engagement with traverse bracket screws 43 which are then tightened to clamp the brackets 11 to the wall and tighten the traverse rod brackets thereto. An ornamental device 13 is mounted on a respective head 39 at any convenient time as earlier explained.

When the devices 10 are employed without the wall mounted traverse rod the brackets 11 are secured directly to the wall by means of screws 43 directly engaging slots 19 and bearing on the bordering surfaces. The festoon support devices 12 are then coupled to respective brackets 11 as aforesaid.

Any desired festoon F, preferrably of cloth, fabric or the like, is looped or hung across the wall mounted pair of laterally spaced support members 12, the rear border of the festoon being slipped under respective clip springs 36 to releasably clamp the festoon in selected position on arms 26 in engagement with serrated strips 37. The festoon may be hung in the above manner when the devices 10 are employed with or without a traverse rod or a curtain rod 14.

Where used in this application, "traverse rod" is deemed to include other type of rods for carrying or supporting drapes, curtains or the like. While a traverse rod is not necessary for festoons, it is used for hanging a curtain or drape that may be used with the festoon.

While there has been described and illustrated a preferred embodiment of the present invention, it is apparent that numerous alterations, omissions and additions may be made without departing from the spirit thereof.

I claim:

1. A festoon support device comprising a mounting bracket, a forwardly projecting festoon support arm separably coupled at its rear to said mounting bracket, coupling rod coupling means affixed to the rear portion of said support arm and including a forwardly open socket means defined by a lateral U-shaped loop depending from and integrally formed with the rear portion of said festoon support arm for separably receiving a rearwardly directed leg of a curtain rod and an ornament mounted on the front end of said support arm.

2. The device of claim 1 including means for separably attaching said ornament to the front end of said support arm for angular adjustment about a point eccentric to said ornament.

3. The device of claim 1 wherein said mounting bracket includes vertically spaced horizontally extending confronting upper and lower channels formed in the front face thereof and said support projecting lip slidably engaging said upper and lower channels respectively.

4. The device of claim 1 including a longitudinally extending spring clip member anchored at its rear to the top face of said support arm proximate the rear portion thereof and having its front end resiliently biased downwardly toward engagement with said support arm top face.

5. The device of claim 4 wherein said support arm top face along opposite sides of said spring clip member is serrated.

6. A festoon support device comprising a mounting bracket, including vertically spaced horizontally extending confronting upper and lower channels formed in the front face thereof, a forwardly projecting festoon support arm having integrally formed at its rear portion an upwardly projecting lip and a curtain rod coupling, forwardly open socket means defined by a lateral U-shaped loop depending from and integrally formed with a rear portion of said festoon support arm, said lip and lower part of said loop laterally slidably engaging said upper and lower channels respectively, a longitudinally extending spring clip member anchored at its rear to the top face of said support arm proximate the medial rear portion thereof and having its front end resiliently biased downwardly toward engagement with said support arm top face, said support arm top face along opposite sides of said spring clip of being serrated, an ornament and means for separably attaching said ornament to the front end of said support arms for angular adjustment about the longitudinal axis of said support arm.

* * * * *